US005174670A

United States Patent [19]

Takagi et al.

[11] Patent Number: 5,174,670

[45] Date of Patent: Dec. 29, 1992

[54] TAPE PRINTER WITH END TRIMMING CUTTER

[75] Inventors: Yukihito Takagi; Teruo Imamaki, both of Kasugai; Shigeru Nakata, Nagoya, all of Japan

[73] Assignee: Brother Kogyo Kabushiki Kaisha, Nagoya, Japan

[21] Appl. No.: 653,404

[22] Filed: Feb. 11, 1991

[30] Foreign Application Priority Data

Mar. 29, 1990 [JP] Japan ..... 2-81939
May 17, 1990 [JP] Japan ..... 2-127768

[51] Int. Cl.[5] ..... B41J 11/70
[52] U.S. Cl. ..... 400/621; 101/226
[58] Field of Search ..... 400/134.5, 134.6, 621, 400/621.1, 621.2; 101/226, 227, 224; 83/649, 830, 831; 225/7, 9

[56] References Cited

U.S. PATENT DOCUMENTS

| | | | |
|---|---|---|---|
| 2,291,668 | 8/1942 | Weigolt | 83/649 |
| 3,310,145 | 2/1964 | Pedersen | 400/134.5 |
| 3,366,212 | 6/1968 | McInnis | 400/134.5 |
| 3,622,425 | 11/1971 | Savarick | 352/130 |
| 4,413,621 | 11/1983 | McCracken et al. | 128/156 |
| 4,667,665 | 5/1987 | Blanco et al. | 128/156 |
| 4,815,874 | 3/1989 | Richardson et al. | 400/621 |
| 4,927,278 | 5/1990 | Kuzuya et al. | 400/208 |
| 5,022,771 | 6/1991 | Paque | 400/613 |
| 5,025,725 | 6/1991 | Fukino | 101/226 |

FOREIGN PATENT DOCUMENTS

| | | | |
|---|---|---|---|
| 0319209 | 6/1989 | European Pat. Off. . | |
| 47-16105 | 5/1972 | Japan . | |
| 47681 | 3/1982 | Japan | 400/621 |
| 1-23423 | 7/1989 | Japan . | |

*Primary Examiner*—Edgar S. Burr
*Assistant Examiner*—Ren Yan
*Attorney, Agent, or Firm*—Oliff & Berridge

[57] ABSTRACT

A tape printer for making adhesive labels includes a tape supply, a printer for reverse printing on the tape and a double-sided adhesive film, one side of which is laminated to the printer tape and the other side of which carries a release paper. The printer has a cutter for cutting the tape from the continuous supply tape and includes a trimmer for rounding the corners of the tape to reduce defoliation of the tape from the surface to which it is applied. The cutting blade of the trimmer has a central straight section, contiguous arcuate sections at each end of the central straight section and auxiliary straight cutting edges contiguous with the arcuate sections and extending at an obtuse angle to the central straight section. The cutting blade is mounted in an integrally molded support unit which includes guide members for guiding the width of tape to be trimmed by the cutting blade. The support unit is detachably mounted on a tape support member so that tapes of differing widths can be trimmed by interchanging the support units. Levers for actuating the cutting blade are movable from a position to actuate the cutter to a retracted position enabling replacement of the support unit.

19 Claims, 13 Drawing Sheets

R
4

4

4

4

4

4

TAPE PRINTER WITH END TRIMMING CUTTER

BACKGROUND OF THE INVENTION

1. Field of the Invention

This invention relates to a printing apparatus for printing letters and other characters on a printing medium in the form of a tape-like strip.

2. Description of the Prior Art

Heretofore, a printing apparatus of this sort has been known, for example, from Japanese Patent Publication 47-16105 and Laid-Open European Patent Application 0 319 209, in which letters and characters are printed on a tape-like printing medium and a printed part of the tape is cut to a predetermined length by means of a cutter blade. The cutter blade is usually of a straight or arcuate shape to cut the tape into a strip with a straight or arcuate end shape.

In case of a printed tape strip which has rectilinearly cut ends, it can be easily set in a predetermined position on a surface to which the tape is to be adhered, but it involves a problem that the four corners of the tape strip tend to separate from the bonded surface, which eventually leads to defoliation of the entire tape strip. On the other hand, in case of a tape strip with arcuately cut ends, it is less susceptible to defoliation, but difficulties are often experienced in setting the tape strip exactly in alignment with a certain line or edge of a predetermined adhering position. Moreover, the printing apparatus which is provided with either a straight cutter blade or an arcuate cutter blade restricts the user's choice to only one end shape. Further, there has been a problem that such a printed tape strip contains excessively large blank portions at the opposite ends, necessitating the user to cut off such blank portions afterwards with the use of scissors or other suitable tools.

SUMMARY OF THE INVENTION

The present invention contemplates to eliminate the above-mentioned problems or drawbacks, and has as its object the provision of a printing apparatus which is provided with means for trimming the end of a tape-like printing medium into a desired shape in a simplified manner.

According to the present invention, there is provided, for achieving the above-stated objective, a printing apparatus of the type adapted to print letters or characters on a tape-like printing medium and having a first cutter mechanism for severing the printed part of the tape-like medium, the printing apparatus comprising: a second cutter mechanism for trimming the end of the printed strip of the tape-like medium into a desired shape.

The printing apparatus of the invention, with the above arrangement including the second cutter mechanism, is capable of trimming into a desired shape the end of the printed tape strip which has been cut off by the first cutter mechanism and, if necessary, cutting off an excessive blank portion from the tape end.

Thus, according to the present invention, there can be provided a printing apparatus which permits to cut off or trim the end of a printing medium into a desired shape in an extremely simplified manner.

BRIEF DESCRIPTION OF THE DRAWINGS

The above and other objects, features and advantages of the invention will become apparent from the following description and the appended claims, taken in conjunction with the accompanying drawings which show a preferred embodiment of the invention and wherein:

DESCRIPTION OF PREFERRED EMBODIMENTS

Figure 1:
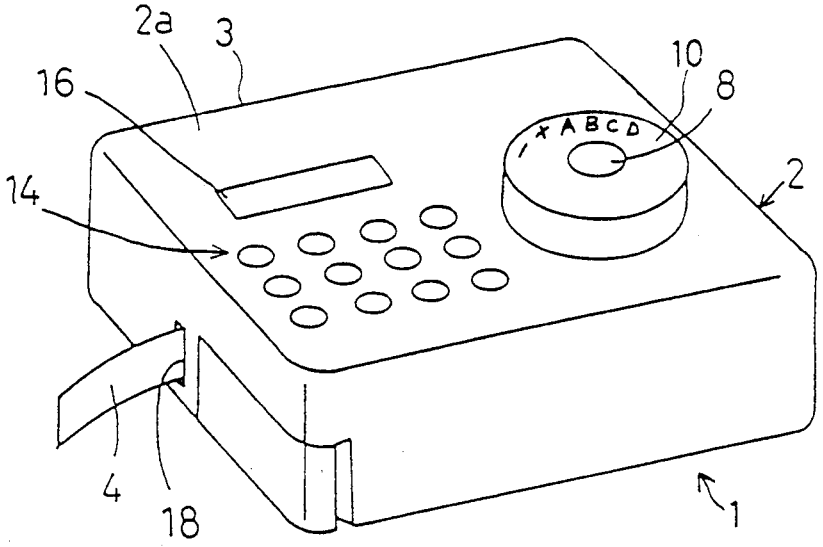
FIG. 1 is a perspective view of a printing apparatus.

Hereafter, the invention is described particularly by way of the preferred embodiment shown in the drawings.

Figure 2:
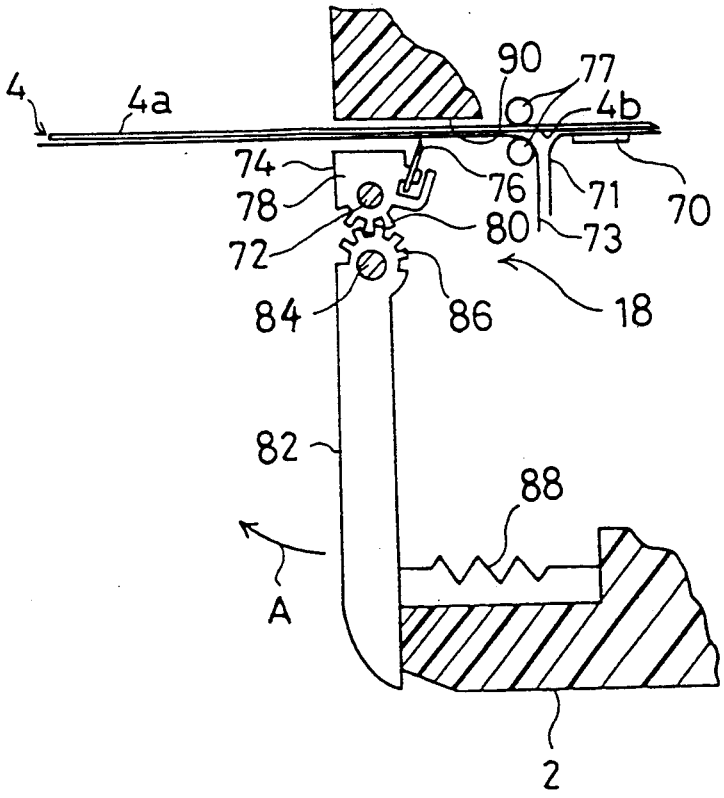
FIG. 2 is a view of a first cutter mechanism serving as a tape cutter mechanism.
Figure 6:
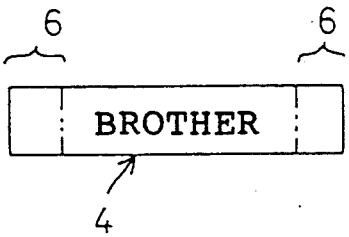
FIG. 6 is a front view of a tape strip which has been severed by the tape cutter mechanism after printing.

Referring to FIG. 1, there is shown in a perspective view a printing apparatus embodying the present invention, which includes a letter selector dial 8 rotatably mounted on a top surface 2*a* of a housing 2 and having an annular dial surface 10 bearing thereon alphabetic letters, numeric figures, characters, symbols etc. to be entered. Provided side by side with the selector dial 8 are a group of function keys 14 which control various functions of the printing apparatus 1 including, indicating an entered letter on a liquid crystal display 16 and printing same on a transparent tape 4. Referring to FIG. 2, the letter is printed by a thermal type printing head 70 which thermally transfers ink from an ink ribbon 71 onto the tape 4. In this printing operation, each character is printed as a laterally reversed image on the transparent tape 4. Accordingly, each character can be viewed as a normal image from the other side 4*a* of the transparent tape 4 away from the printed face 4*b*. As the printed portion of the tape 4 is fed past the printing head 70, a double-face adhesive tape 73 with a peelable tape on one side thereof is adhered on the printed face 4*b* of the tape 4 by a pair of presser rollers 77. The tape 4, ink ribbon 71 and adhesive tape with a peelable backing tape on one side are wound into rolls and accommodated in a common cartridge (not shown) which is detachably mounted in the printing apparatus 1. The printed tape 4 bonded with the double-face adhesive tape is discharged out of the housing 2 through a tape outlet. The discharged tape 4 is severed by a first cutter mechanism, namely, by a cutting mechanism 18 which is provided with a cutter blade within a casing. The tape is cut off when it is fed to a position where its printed portion is directly visible to the operator. Accordingly, the tape 4 can be cut off with a blank tape portion of a predetermined length posterior to the printed portion. As a result, there is obtained a printed tape cut into a desired length, for example, a strip of printed tape 4 as shown in FIG. 6. The above-described arrangement of the printing apparatus is substantially the same as the one which is disclosed in Laid-Open European Patent Application Publication No. 0 319 209. Similar apparatus is disclosed in U.S. Pat. No. 4,927,278. Both documents are incorporated herein by reference. As mentioned hereinbefore, the printing apparatus further includes an end trimming mechanism 20 as a second cutter mechanism for trimming an end portion 6 of the tape 4 which has been cut off in the above-described manner. The end trimming mechanism 20 is provided integrally on the top side 3 of the housing 2 of the printing apparatus 1, so that the operator can readily trim the tape end whenever necessary.

Reference is had to FIG. 2 which shows the first cutting mechanism 18. As seen in this figure, a cutter shaft 72 is provided within the housing 2 at a position downstream of the printing head 70. Rotatably supported on shaft 72 is a cutter member 74 which is operable to cut off a printed portion of the tape 4. The cutter member 74 is constituted by a straight cutter blade 76 for severing the tape 4, and a blade holder 78 which holds the cutter blade 76. The blade holder 78 is provided with a bore formed vertically therethrough for receiving the cutter shaft 72, and a cutter gear portion 80 is formed on a circumferential side portion about the bore. The cutter member 74 is rotated by a cutter lever 82 which is rotatably mounted on a lever shaft 84 which is provided within the housing 2. The cutter lever 82 is integrally provided with a lever gear 86 which is formed about the lever shaft 84 for meshing engagement with the cutter gear 80. More specifically, the cutter gear 80 of the cutter member 74 and the lever gear 86 of the cutter lever 82 which meshes with the cutter gear 80 are meshed with each other through a plural number of teeth which are provided in a circumferential direction about the respective pivoting shafts to transfer rotational force in the circumferential direction without transfer of force therebetween in a direction perpendicular to the circumferential direction to permit mounting and extraction of the cutter member 74. Further, the cutter lever 82 is biased in a direction opposite to the direction of arrow A by a spring 88 to abut against a side wall of the housing 2, so that the cutter blade 76 is normally retained in a position away from the tape 4. An anvil 90 is located on the other side of the tape 4 away from the cutter blade 76.

The tape 4 which is fed forward by a feeder mechanism, which is not shown, and led to a path between the cutter member 74 and the anvil 90. In this state, by rotating the cutter lever 82 in the direction of arrow A in FIG. 2, the cutter member 74 is rotated counterclockwise in FIG. 2 through the lever gear 86 and cutter gear 80. Whereupon, the tape 4 is pressed against the anvil 90 and severed by the cutter blade 76.

Figure 3:
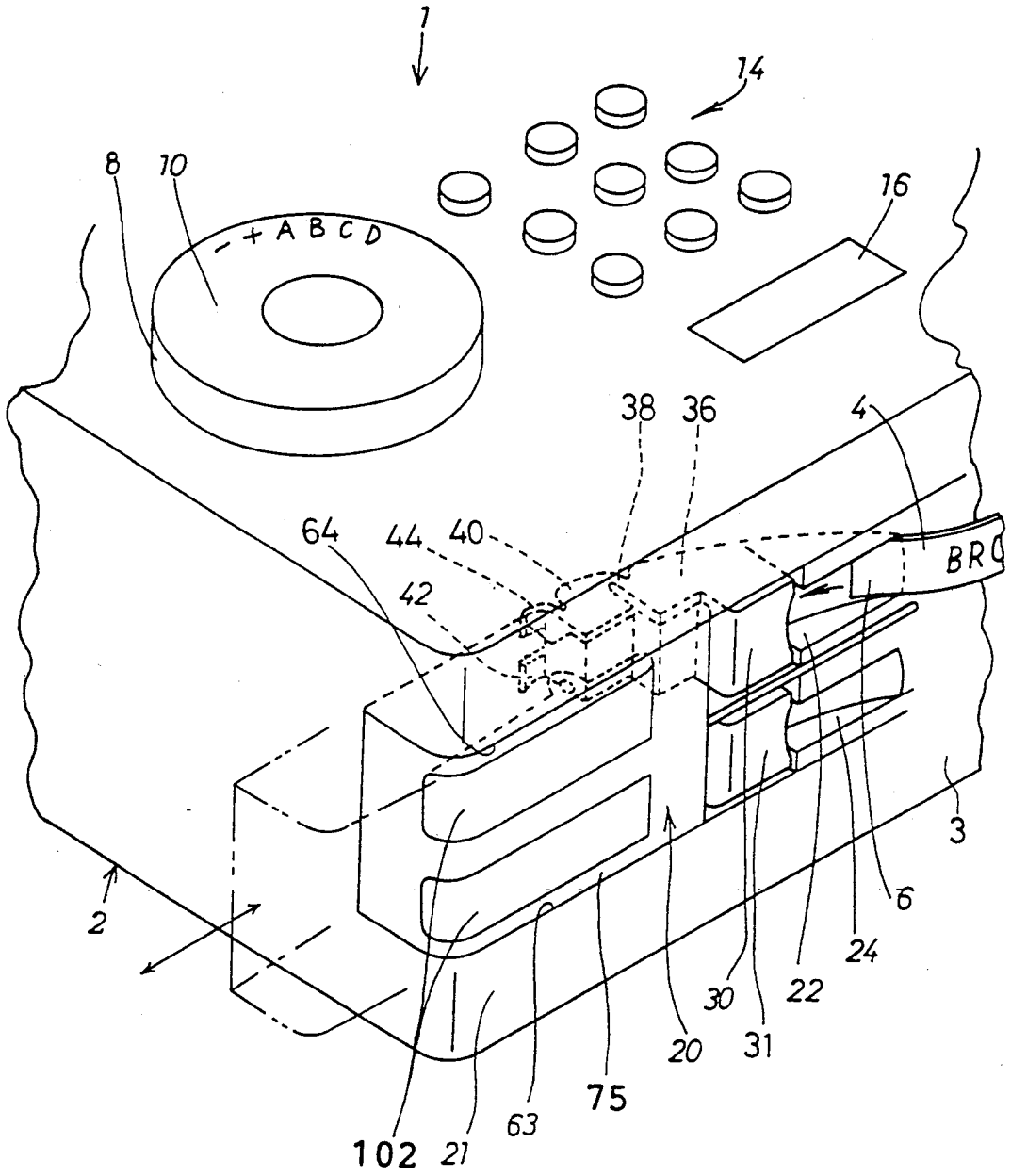
FIG. 3 is a view of a second cutter mechanism serving as an end trimming mechanism.

Turning now to the trimming mechanism 20 for trimming an end 6 of the tape strip which has been printed and cut off in the above-described manner, such a mechanism is provided on one side wall 3 of the housing 2 as shown particularly in FIG. 3 such that part of the housing 2 forms a casing 21 for the trimming mechanism 20. In this particular embodiment, the trimming mechanism 20 is provided with a guide groove 22 for a 12 mm-wide tape and a guide groove 24 for a 16 mm-wide tape side by side. The trimming cutter mechanisms for these tape widths are substantially the same in construction except that the dimensions of tape guide portion and cutter blade are varied according to the tape width. Therefore, the trimming cutter mechanism is explained hereinafter by way of the mechanism for 12 mm-wide tape.

The guide groove 22 is formed by recessing the side wall 3 according to the width of the tape 4 in such a manner as to receive the tape strip 4 therein with the tape face 5 in a horizontal state. The guide groove 22 is internally provided with a stopper surface 25 (FIG. 9) which delimits the depth of insertion of the tape 4 by abutting engagement therewith.

Figure 4:
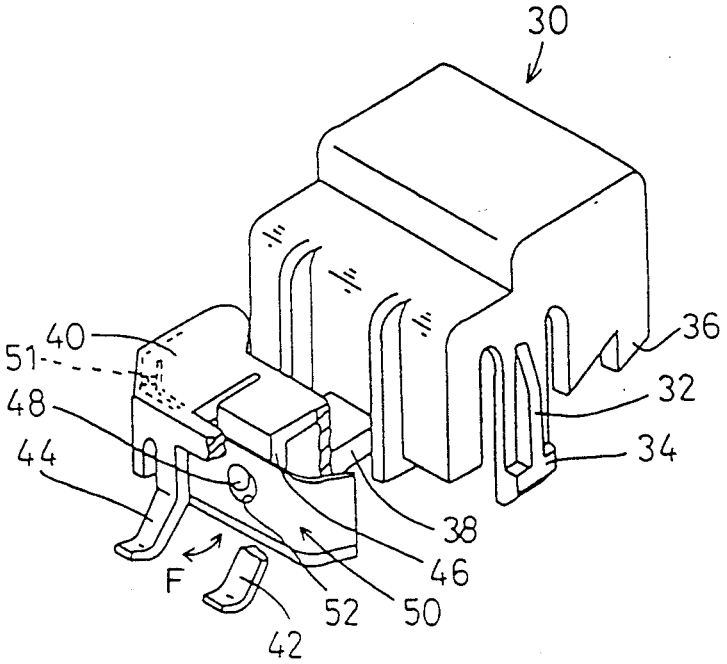
FIG. 4 is an enlarged perspective view of a cutter holder.

Provided within the guide groove 22 is a cutter holder 30 which is positioned astride the inserted tape 4, the cutter holder 30 being provided with locking portions 32 (only one of which is shown in FIG. 4) each with a anchor pawl 34 at the lower end thereof. The cutter holder 30 is detachably and replaceably fixed on the casing 21 through engagement of the anchor pawls 34 with the casing 21.

Figure 13:
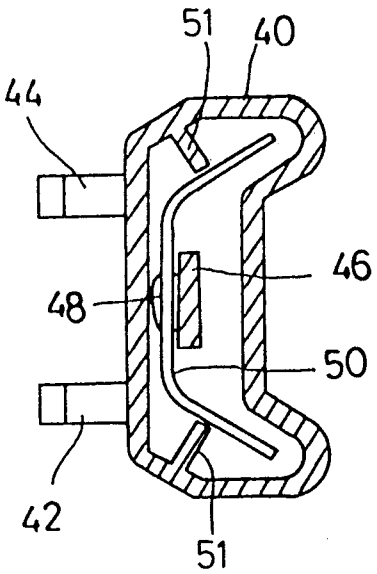
FIG. 13 is a transverse section of a cover portion.

The cutter holder 30 is provided with a tape guide portion 36 which prevents the tape 4 from flexing up upon insertion into the guide groove 22, ensuring that the tape 4 be inserted in an appropriate position along the guide groove 22. The cutter holder 30 is further provided with a resiliently deformable portion 38, which is extended toward the stopper surface 25 substantially in parallel relation with the inserted tape 4 and provided with a hollow cover portion 40 at the fore end thereof. FIG. 13 shows the cover portion 40 in a transverse sectional view. A pair of presser legs 42 and 44 are extended obliquely from the cover portion 40 toward the tape surface 4*a* thereby to press the end portion 6 of the tape 4 against the guide groove 22.

Figure 5:
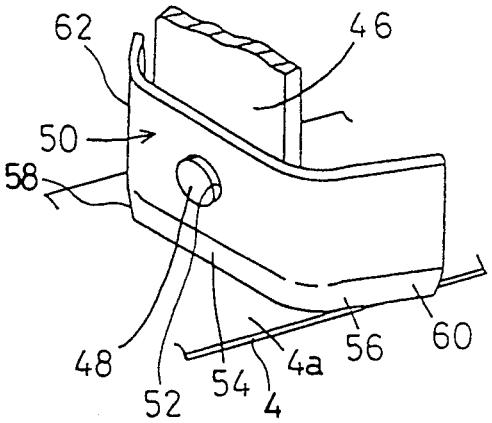
FIG. 5 is an enlarged perspective view of a cutter blade.
Figure 14:
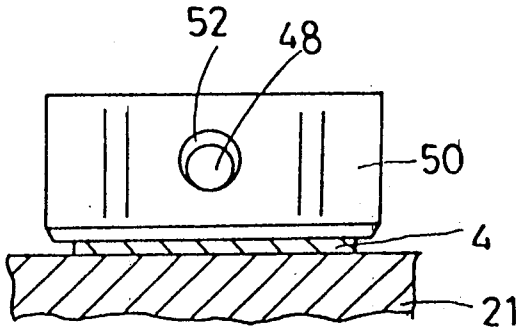
FIG. 14 is a schematic illustration explanatory of the condition of the cutter blade abutted against the tape.

The cover portion 40 is partly notched and interiorly formed with a pendant holder portion 46 extending downwardly toward the tape surface 4*a*. A pin 48 which is inserted in the holder portion 46 is inserted into a hole 52 in a cutter blade 50 to permit the latter to rock about the pin 48. The pin 48 has a diameter which is smaller than that of the hole 52 in a predetermined degree. The cutter blade 50 is engaged with the pin 48 so that it can rock back and forth and to the left and right as indicated by arrow F in FIG. 4. Accordingly, as shown in FIGS. 5 and 14, the cutter blade 50 is uniformly and stably abutted against the tape surface 4*a*. In this connection, a rib 51 which is formed on the inner side of the cover portion 40 is extended toward the cutter blade 50 to prevent its dislocation from the pin 48.

Figure 7:
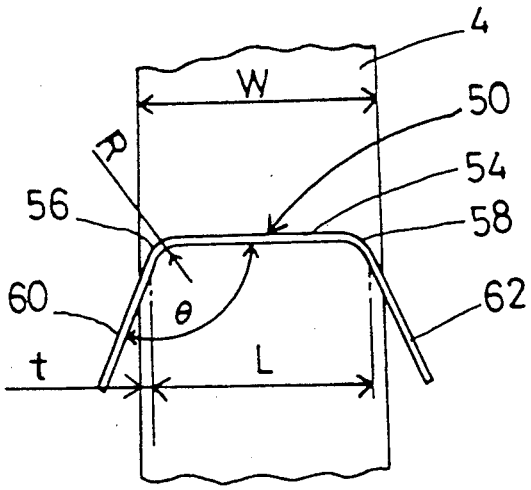
FIG. 7 is a schematic illustration explanatory of the cutter blade.
Figure 8:
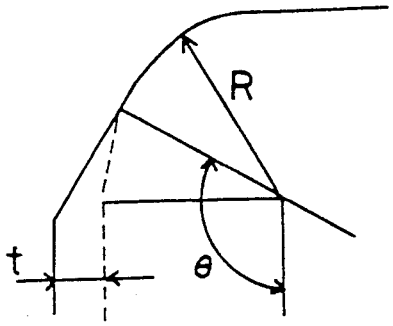
FIG. 8 is an illustration explanatory of the tape strip severed by the cutter blade.

The cutter blade 50 is provided with a straight cutting edge 54 which is extended across the width of the tape 4 as shown in FIGS. 4 and 5. Arcuate cutting edges 56 and 58 with a radius R are formed contiguously on the opposite sides of the straight cutting edge 54. Further, straight auxiliary cutting edges 60 and 62 are extended contiguously from the arcuate cutting edges 56 and 58, each in a direction tangential to the circle of the radius R to form an obtuse angle $\theta$ with the straight cutting edge 54. Although the angle $\theta$ is set at 120° in this particular embodiment, it should suitably fall in a range between 105° and 140°. In a case where the angle $\theta$ of the arcuate cutting edges 56 and 58 is as shown in FIGS. 7 and 8, the end corners of the tape 4 are trimmed into a round shape. Where the angle $\theta$ is increased beyond 120°, the rounding-off effect on the trimmed tape end corners becomes less perceivable in appearance.

Moreover, the 12 mm tape 4 has a tolerance t of +0.5 mm in width W. It follows that the minimum width L of the tape 4 is 11.5 mm. To cope with the minimum width L, in this embodiment the aforementioned straight cutting edge 54 and the two arcuate cutting edges 56 and 58 are formed in a width corresponding to the minimum width L. Namely, even when trimming a tape strip of the minimum width, at least the tape end corners are rounded off by the arcuate cutting edges 56 and 58. If the straight cutting edge 54 and the arcuate cutting edges 56 and 58 are formed in a width smaller than the minimum width L, greater proportions of the tape are cut by the auxiliary cutting edges, which give an effect of straight cut rather than the rounding-off effect. Therefore, it would impair the smoothness of the rounding-off.

In this particular embodiment, the cutter blade 50 is formed by arcuately bending a straight blade of SK material, of Shore hardness of about HS60, to form arcuate bends of the radius R, namely, to form the straight cutting edge 54, arcuate cutting edges 56 and 58, and auxiliary cutting edges 60 and 62.

A cutter holder 30 and cutter blade 50 of the same construction are also provided for trimming, for example, 9 mm-wide tape strips.

Figure 9:
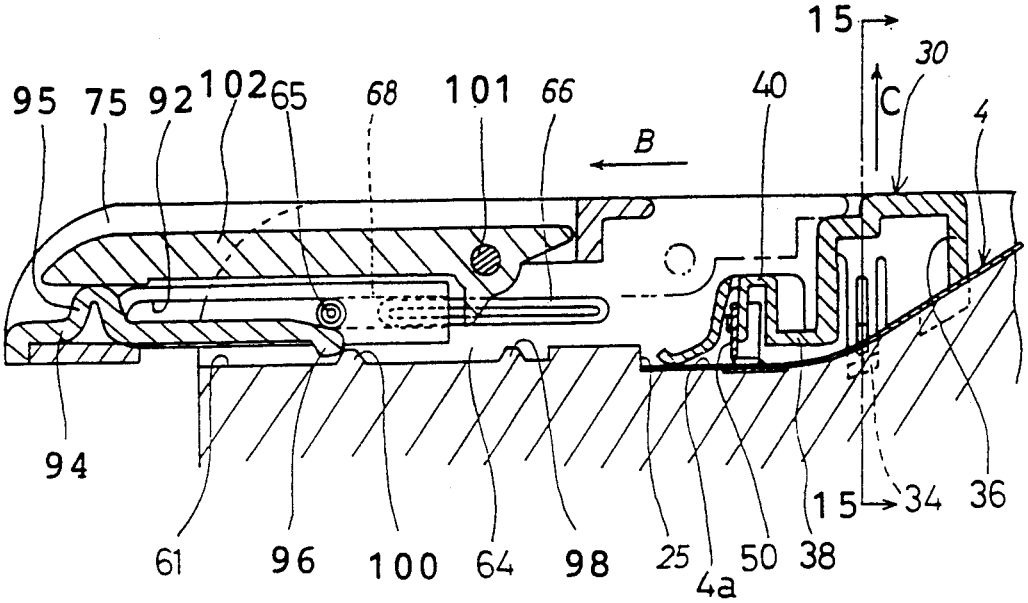
FIG. 9 is a sectional view of the trimmer shown in full line position in FIG. 3.
Figure 10:
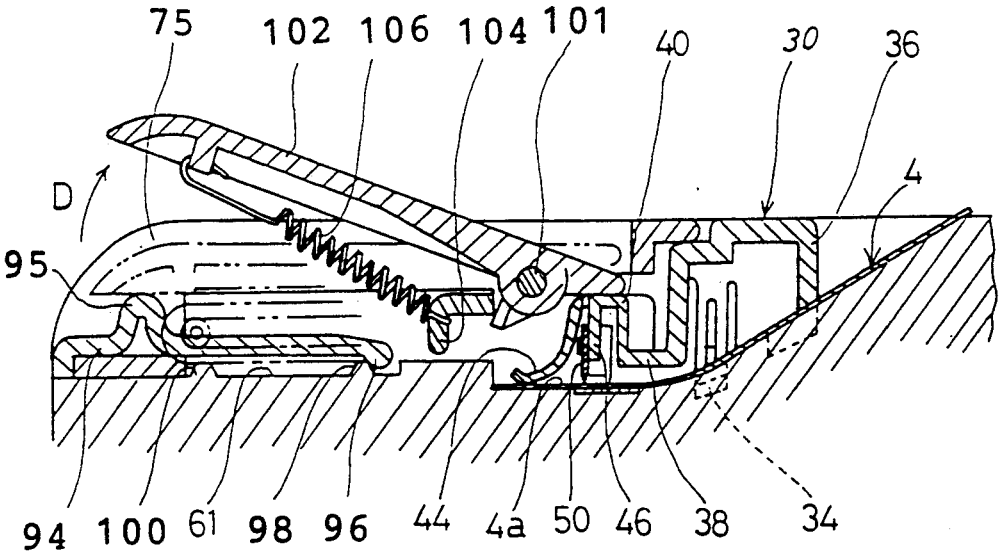
FIG. 10 is a sectional view of the trimmer shown in dotted line position in FIG. 3.
Figure 11:
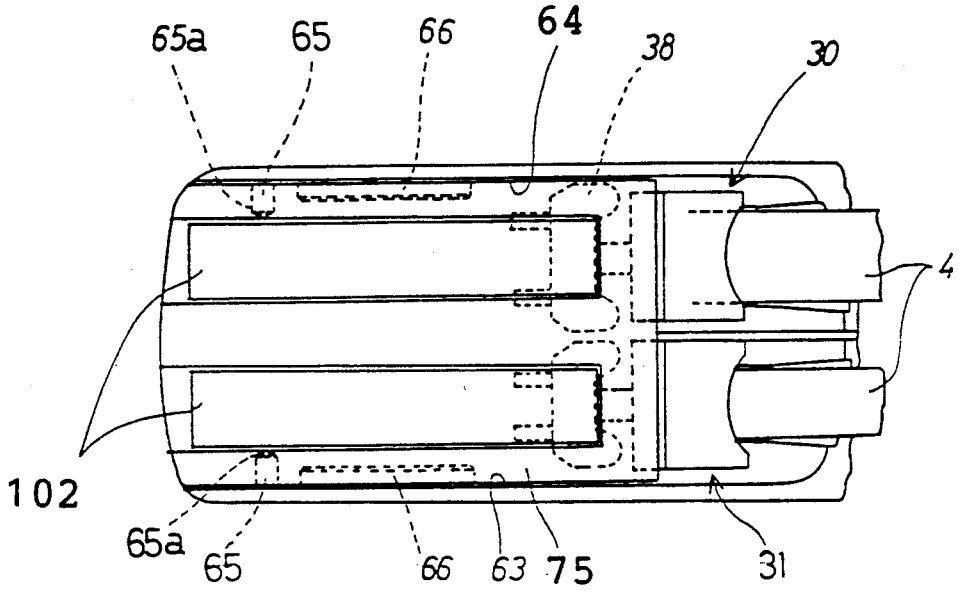
FIG. 11 is a top view of an end shaping mechanism in an operable position.
Figure 12:
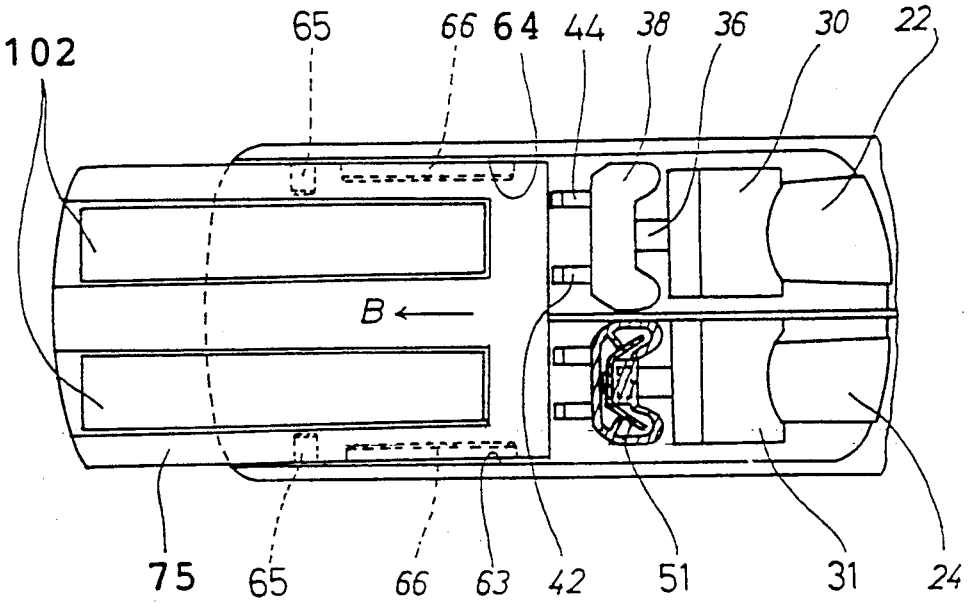
FIG. 12 is a top view of the end shaping mechanism in a retracted position.

Further, as shown in FIGS. 3, 9 and 10, the side wall 3 of the housing 2 is recessed to form, as part of the casing 21, a bottom surface 61 extending parallel with the side wall 3 at a certain depth from the surface of the side wall 3, and opposed walls 63 and 64 extending perpendicularly to the side wall 3. As shown in FIGS. 11 and 12, a positioning pin 65 and a transport rail 66 are projectingly provided on each of these walls 63 and 64 in face to face relation with the counterparts on the opposite wall. The transport rails 66 are extended parallel with the bottom surface 61, and the positioning pins 65 are projected in a greater degree than the transport rails 66.

The trimming cutter mechanism 20 further includes a lever holder or frame 75, which is provided with rail guide 68 in sliding engagement with the positioning pins 65 and transport rails 66 for sliding movement in a direction parallel with the bottom surface 61. The rail guide is provided with slot-like stopper grooves 92 which are engaged with the distal end portions of the positioning pins 65. When the lever holder 75 is slid parallel with the bottom surface 61, it is abutted against the positioning pins 65 at the opposite ends of the stopper grooves 92 to delimit the range of its sliding movement between a operable position and a retracted position as will be described hereinlater.

Further, the lever holder 75 is provided with a plate-like locking arm 94 which is extended parallel with the bottom surface 61 and bent in the middle to form a projection 95 of U-shape in section. The fore end of the locking arm 94 is provided with a projection 96 toward the bottom surface 61, while a pair of locking ridges 98 and 100 are projectingly provided on the bottom surface at two spaced positions, namely, at a operable position and a retracted position. The locking arm 94 is formed of a resiliently deformable material, so that, if a force greater than a certain level is applied in a sliding direction, it can be moved in that direction, riding over the locking ridges 98 and 100.

A lever 102 is rockably supporting on a rocking shaft 101 which is provided on the lever holder 75, the lever 102 being pulled toward the bottom surface 61 and normally folded into lever holder 75 by a tension spring 106 which is connected at one end to the lever 102 and at the other end to a hook portion 104 provided on the lever holder 75. When folded, the lever 102 is abutted against the projection 95 to block further sliding movement toward the bottom surface 61.

The lever holder 75 is slid in the forward direction or toward the cutter holder 30 to assume the operable position where its forward sliding movement is stopped by abutting engagement of the positioning pins 65 with fore ends of the stopper grooves 92, and the lever 102 is rocked in the direction of arrow D against the action of the tension spring 106 as shown in FIG. 10, pushing down the holder portion 40 of the cutter holder 30 to move the cutter blade 50 toward the tape surface 4*a*. The lever holder 75 is slid in the rearward direction away from the cutter holder 30 to assume the retracted position where its rearward sliding movement is stopped by abutting engagement of the positioning pins 65 with the ends of the stopper grooves 92 as shown in FIG. 9, retracting the lever 102 from the cutter holder 30 so that the cutter holder 30 can be removed from the guide groove 22 from above.

Figure 16:
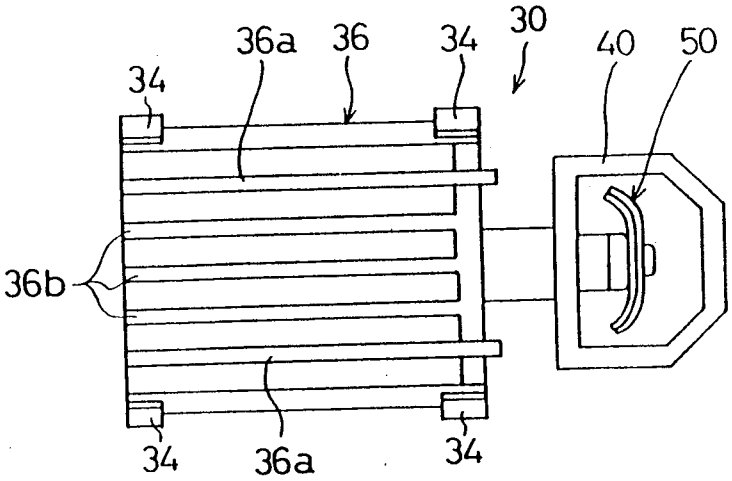
FIG. 16 is a bottom view of a cutter holder with an integrally molded structure.
Figure 15:
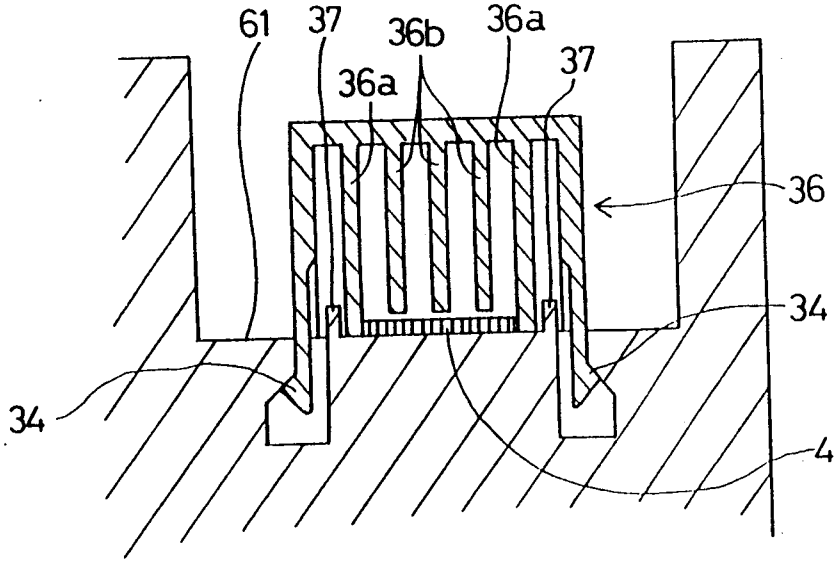
FIG. 15 is a sectional view taken on lien 15—15 of FIG. 9.

The interior construction of the tape guide 36 is now explained with reference to FIG. 15, which is a section taken on line 15—15 of FIG. 9, and to FIG. 16, which is a bottom view of the tape guide 36 integrally formed with the cutter holder 30. As shown in FIG. 15, the tape guide 36 is interiorly provided with a number of parallel guide plates 36*a* and 36*b*, of which the outermost guide plates 36*a* are abutted on the bottom surface 61 while the three center guide plates 36*b* are spaced from the bottom surface 61 by a gap which is slightly wider than the thickness of the tape 4. On the bottom surface 61, ribs 37 are formed. The ribs 37 are located outwardly of the outermost guide plates 36*a* substantially along the entire length of the tape guide 36.

In operation, for trimming an end of a tape strip 4, the trimming cutter of this embodiment is used in the operable position shown in FIG. 10. Firstly, the operator inserts the tape strip 4 along the guide groove 22. At this time, sideward movements of the tape 4, which is being guided along the guide groove 22, are restricted by the guide plates 36*a* which are abutted against the bottom surface 61. Consequently, the center of the tape 4 is guided toward the center of the cutter blade 50. In the meantime, the three guide plates 36*b*, which are spaced from the bottom surface 61 by a gap of a predetermined width, serve to prevent the tape 4 from flexing away from the surface 61. Further, the leading end of the tape 4 is abutted against the stopper surface 25 which delimits the length of insertion of the tape 4. Therefore, the tape 4 is set in a centered position relative to the cutter blade 50 which is located at a predetermined distance from the leading end of the tape 4. In this operable position, the positioning pins 65 are abutted against the rear ends of the stopper grooves 92 to block further movement of the lever holder 75 toward the cutter holder 30. In addition, the projection 96 of the locking arm 94 is abutted against the locking ridge 98, to the side of the cutter holder 30, preventing the lever holder 75 from easily moving in a direction away from the cutter holder 30. As soon as the lever 102 is rocked by the operator in the direction of arrow D against the force of the tension spring 106, the holder portion 40 of the cutter holder 30 is pushed down by one end of the lever 102. Whereupon, the presser legs 42 and 44 are flexed to press the end portion 6 of the tape strip 4 against the guide groove 22, and the resilient portion 38 is displaced downward through elastic deformation, moving the cutting edges 54, 56 and 58 of the cutter blade 50 toward the tape surface 5 for trimming the tape 4.

Figure 17A:
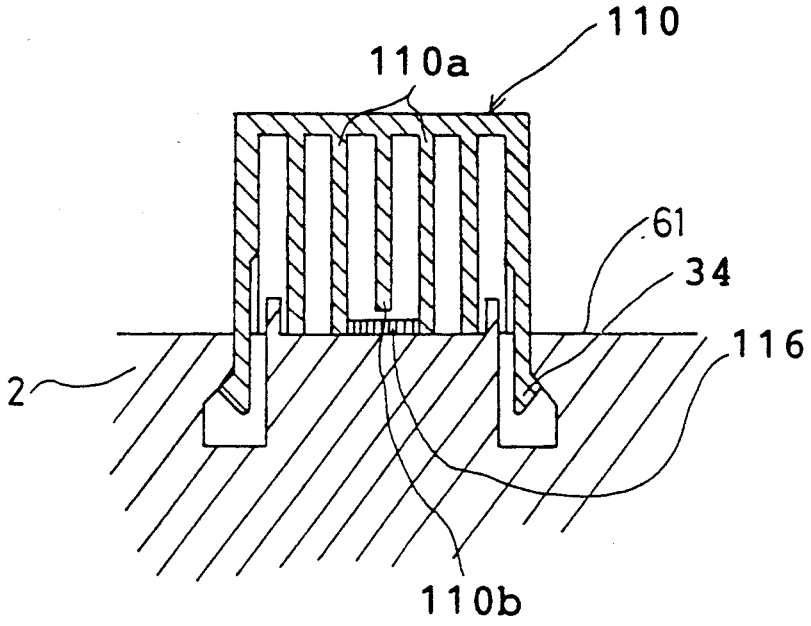
FIGS. 17(A) and 17(B) are sectional views of tape guides for different tape widths.
Figure 17B:
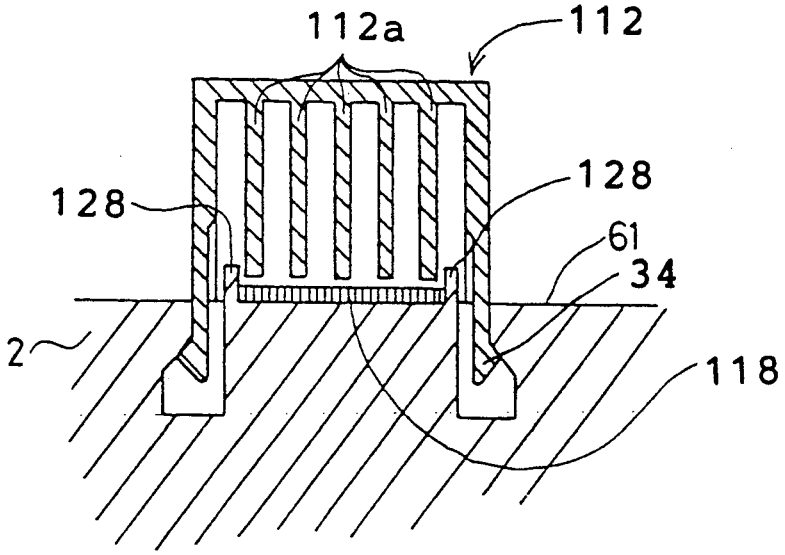

On the other hand, when the tape 4, ink ribbon 71 and cartridge of the double-face adhesive tape 73 are replaced for printing a tape 116 or 118 of a different width from the tape 4, the cutter holder 30 which is detachably fixed on the bottom surface 61 through the anchor pawls 34 is replaced by a cutter holder with a tape guide 110 or 112 having a sectional shape as exemplified in FIG. 17(A) or 17(B) instead of the tape guide 36, according to the width of the tape 116 or 118. The tape guide 110 or 112 is mounted in position through anchor pawls 34. In this case, the cutter blade 50 which is fixed on the holder portion 40 of the cutter holder 30 is replaced together with the latter. Accordingly, the cutter blade 50 is replaced by a blade of the size and shape conforming with the new tape. The tape 116 or 118 is trimmed accurately in a suitable shape by the same operations as explained hereinbefore in connection with the tape 4.

As shown in FIG. 17(A), the tape guide 110 is shaped such that guide plates 110*a* on the opposite sides of a center guide plate 110*b* are abutted against the bottom surface 61. Therefore, the cutter holder with such a tape guide 110 needs a cutter blade having a cutting edge shorter than the cutter blade 50 in the cutter holder 30. In case of this cutter holder, sideward movement of the smaller width tape 116 is restricted by the guide plates 110*a*. That is, the center of the tape 116 which is smaller in width than the tape 4 is guided toward the center position of the cutter blade and cut accurately in a desired shape by the cutter blade of suitable size and shape.

On the other hand, as shown in FIG. 17(B), the tape guide 112 is shaped such that, when mounted on the trimming mechanism 20, all of the guide plates 112*a* are spaced from the bottom surface 61 by a gap which is slightly greater than the thickness of the tape. Accordingly, the cutter holder with the tape guide 112 has a cutter blade with a cutting edge longer than the blade 50 on the cutter holder 30. In case of this cutter holder, sideward movement of the tape is restricted by the ribs 128 provided on the bottom surface 61. Therefore, the center tape 118 which is larger in width than the tape 4 is guided in centered relationship with the cutter blade and cut exactly in a desired shape by a cutter blade of a size and shape conforming with the tape width.

In the end trimming operation, the straight cutting edge 54 of the cutter blade 50 cuts the tape 4 along a straight cut line in the transverse direction of the tape. Concurrently, the arcuate cutting edges 56 and 58 of the cutter blade 50 cut the tape 4 in an arcuate shape of the radius R contiguously to the straight cut line by the straight cutting edge 54. Further, the auxiliary cutting edges 60 and 62 cut the tape 4 in a direction tangential to the arcs of the radius R and at an obtuse angle $\theta$ with the straight cut line of the straight cutting edge 54. As a consequence, the end 6 of the tape 4 is trimmed into the shape as shown particularly in FIG. 18, with the two corner portions rounded off. Therefore, when the tape strip 4 is bonded on an article, it has less possibility of defoliating from the corners. In addition, the straight cut portion which is formed by the straight cutting edge 54 can be conveniently used when it becomes necessary to bond the tape strip accurately flush with an edge of an article.

Figures 18A, 18B, 19A, 19B, 20A, 20B:
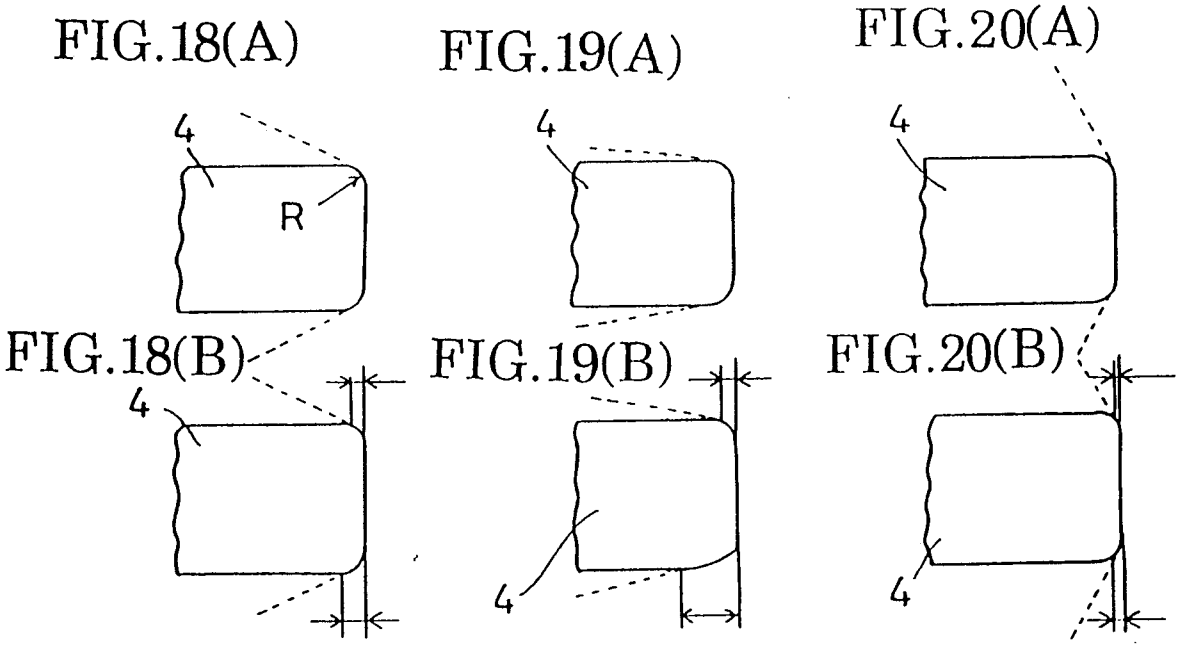
FIGS. 18(A) and 18(B) are schematic illustrations of tapes trimmed by the cutter blade in an embodiment of the invention.
FIGS. 19(A) and 19(B) are schematic illustrations of tapes trimmed by a cuter blade bent approximately at right angles.
FIGS. 20(A) and 20(B) are schematic illustrations of tapes trimmed by a cutter blade with wide angle cutting edges.

Further, there are irregularities in the tape width W, which may be a little broader or narrower than a specified width, while the guide grooves 22 and 24 are provided for 12 mm- and 16 mm-wide tapes, respectively. However, the guide grooves 22 and 24 are formed in a width which is broader to some extent than the width of the corresponding tape to permit irregularities in the tape width W. Therefore, upon insertion into the guide groove 22, the tape 4 might be slightly deviated to one side of the guide groove 22. Even in such a case, the two corner portions of the tape are cut in different degrees but they are at least cut in arcuate shapes by the arcuate cutting edges 56 and 58 in the present embodiment as shown in FIG. 18(B). Namely, the two corners are cut by the arcuate cutting edges 56 and 58 and auxiliary cutting edges 60 and 62 into rounded shapes which are practically acceptable in appearance.

On the other hand, in a case where the angles $\theta$ formed by the straight cutting edge 54 and the auxiliary cutting edges 60 and 62 are closer to right angles, the two corners are trimmed in identical shapes as shown in FIG. 19(A) if the tape is centered relative to the cutter blade 50 without positional deviations. However, if the center of the tape 4 is deviated from the center of the cutter blade 50 due to an irregularity in tape width W, one corner of the tape end is cut off in a greater degree by the auxiliary cutting edge 60 or 62 than the other corner as shown in FIG. 19(B). Thus, the tape 4 is trimmed in a shape which has an unbalanced look, conversely impairing the appearance of the tape.

In a case where the angle $\theta$ of each of the auxiliary cutting edges 60 and 62 is greater than 140°, the two corners of the tape end are likewise trimmed into substantially identical shapes as shown in FIG. 20(A) if the tape 4 is set in the centered position relative to the cutter blade 50 without positional deviations. However, in this case the effect of rounding-off is barely perceivable from the trimmed corners of the tape 4. Besides, if the tape 4 is trimmed in a deviated position relative to the center of the cutter blade 50, the arc at one corner of the tape becomes extremely small as shown in FIG. 20(B), and the trimmed tape end has an unbalanced look.

Figure 21:
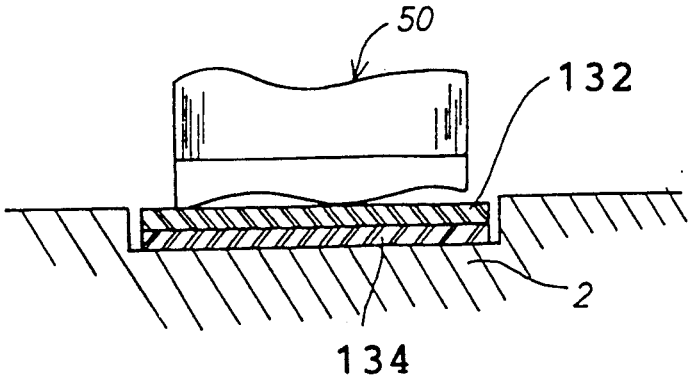
FIG. 21 is a schematic illustration explanatory of a wavy contour which is imparted to the cutting edge in the cutter blade forming process.
Figure 23:
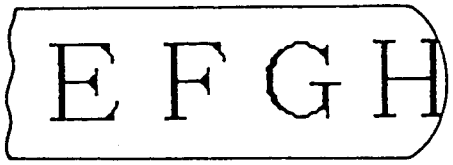
FIG. 23 is a schematic illustration of a tape strip trimmed by a conventional semi-circular cutter blade.

When the cutter blade 50 is formed by a process as described hereinbefore, the edge portions of the blade may have a wavy contour as seen in FIG. 21 which shows the edge portions of the blade on an enlarged scale. Such wavy contour of the cutting edges can be utilized to effect the so-called half-cutting in which the tape 4 is partly left uncut instead of being completely severed. By this half-cutting, a cut is made only into the overlaid tape 4 and the adhesive tape 73 which is bonded to the printed face 4*b* of the tape 4, leaving uncut the peelable backing tape on the other side of the adhesive tape 73. This makes it very easy to remove the peelable backing tape from the tape 4 to which the adhesive tape 73 is bonded, providing a great convenience for the operator.

Figure 22:
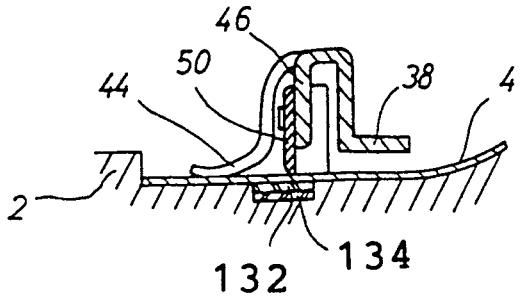
FIG. 22 is a sectional view explanatory of a half-cutting mechanism.

As a half-cutting mechanism, for example, there may be employed an arrangement as shown in FIGS. 21 and 22, cutting the tape 4 between the cutter blade 50 and a metal plate 132 of stainless steel which is embedded in the casing 21 within the guide groove 22 through an adhesive 134 in face to face relation with the cutter blade 50. With this arrangement, the metal plate 132 is pushed down by flexure of the adhesive layer 134 or casing 21 which is caused at the time of the tape trimming operation by the pressure of the cutter blade 50 which is driven downward toward the metal plate 132. The cutter blade 50 is uniformly abutted against the metal plate 132 but leaves part of the tape 4 uncut because of the wavy contour of the cutting edge, thus effecting the half-cutting.

It will be appreciated from the foregoing description that, when necessary, the printing apparatus according to the present invention permits TRIMMING the end 6 of a printed tape strip 4 into a desired shape by an extremely simple operation. The end trimming cutter 20 might get lost if provided separately from the printing apparatus. However, the end trimming cutter 20 which is provided integrally on the side wall of the housing 2 of the printing apparatus 1 is completely free from such a problem.

At the time of replacement of the cutter blade 50, the lever holder 75 in the operable position is pulled in the direction of arrow B away from the cutter holder 30, whereupon the projection 96 rides over the locking ridge 98 on the side of the cutter holder 30 to permit the rail guide 68 to move in the direction of arrow B in sliding contact with the positioning pins 65 and transport rails 66. The locking arm 94 is then flexed to let the projection 96 ride over the other locking claw 100 until the positioning pins 65 come into abutting engagement against the ends of the stopper grooves 92 to assume the retracted position, blocking further movement of the guide rail 68 in the direction of arrow B. In this retracted position, the lever holder 75 will not slide in the direction of arrow B or toward the cutter holder 30 unless a force applied thereto to such a degree as to flex the locking arm 94, letting the projection 96 ride over the locking ridge 100.

After shifting the levers 102 and the lever holder 75 from the operable position to the retracted position in this manner, the locking pawls 34 of the cutter holder 30, which are interlocked with the casing 21, are detached therefrom and the cutter blade 50 is removed out of the guide groove 22 along with the cutter holder 30 in the direction indicated by arrow C. Then, a fresh cutter holder 30 is fixedly set in the predetermined position by interlocking its anchor pawls 34 with the casing 21, and the lever holder 75 is pushed in the opposite direction of arrow B. Whereupon, the locking arm 94 is flexed to let the projection 06 ride over the locking ridge 100 and then the other locking ridge 98. This sliding movement is stopped as soon as the positioning pins 65 come into abutting engagement against the rear ends of the stopper grooves 92, setting the lever holder 75 in the operable position.

When trimming the tape 4 in the above-described manner, the lever 102 in the operable position causes the cutter blade holder 40 to move toward the tape surfaces. On the other hand, in order to replace the cutter blade 50, the lever 102 is shifted from the operable position to the retracted position together with the lever holder 75, and then the cutter blade 50 is detached from the casing 21 for replacement together with the cutter holder 30. Therefore, there is no possibility of the lever 102 interfering with the replacement of the cutting blade. Besides, even in a case where the housing 2 is arranged to form part of the casing 21 of the trimming cutter 20 as in the present embodiment, the cutter blade 50 can be easily removed in the direction of arrow C for replacement. Since the cutter blade is integrally assembled with the tape guide through the cutter holder, a tape guide conforming with the size of a replacing cutter blade is simultaneously provided at the time of replacement of the cutter blade. Therefore, the tape to be trimmed by a fresh cutter blade is securely urged into the centered position by the fresh tape guide, thereby ensuring trimming of the tape end securely in a desired shape. It follows that the end 6 of the tape strip 4 can be trimmed in any desired shape by selectively using one of several cutter blades having different shapes.

Although the trimming cutter mechanism 20 of the present embodiment is provided with a pair of guide grooves 22 and 24 of different widths, it can cope with tapes of various widths by replacing the cutter holders by suitable ones. Therefore, even in case of a trimming cutter which is provided with only a wide guide groove alone, it can trim tape strips of various widths by replacement of the cutter holder.

The ribs 37 which are provided on the bottom surface 61 in the foregoing embodiment may be omitted in a case where the inner wall surfaces are used as guide plates.

Figure 24:
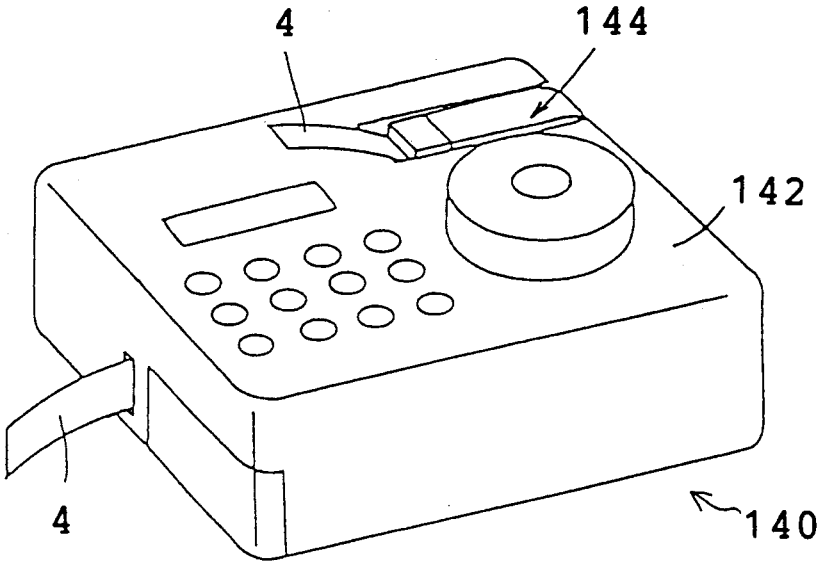
FIG. 24 is a perspective view of a printing apparatus incorporating the cutter of the invention into the top surface of the housing of the printing apparatus.

Furthermore, as the lever holder 75 and other associated components are received in the guide groove 22 as shown in FIG. 3, the trimming cutter 20 can be provided not only on the side wall 3 but also on the top or other side walls of the printing apparatus 1 as long as there is a space corresponding to the size of the guide groove 22. For example, one trimming cutter mechanism 144 may be provided on the top surface 142 of a housing of a printing apparatus 140 as shown in FIG. 24. It follows that the trimming cutter 20 can be incorporated into the printing apparatus 1 without any restrictions with regard to its location.

It is to be understood that the present invention is not restricted to the particular forms shown in the foregoing embodiment, and various modifications and alterations can be added thereto without departing from the scope of the invention as encompassed by the appended claims.

What is claimed is:

1. A tape printing apparatus comprising:

a housing;

a supply means carried by the housing for supplying a continuous length of tape to be printed;

a print means for printing on the tape;

a cutting means for cutting a leading portion of the tape from the continuous length of tape;

trimming means mounted on the housing for trimming end portions of tape cut by the cutting means, said trimming means comprising a support member for supporting tape placed thereon; a cutter member for trimming the tape; means for mounting the cutter member adjacent the tape support member and for movement toward the tape support member; guide means for positioning the tape relative to the cutter member; and driving means for driving the cutter member toward the tape support member to trim tape placed on the tape support member; and movable mounting means for movably mounting the driving means between a first position adjacent the cutter member and a second position spaced away from the cutter member.

2. Apparatus as in claim 1, and further comprising locking means for locking the driving means in one of said first and second positions.

3. Apparatus as in claim 2, wherein the driving means comprises a pivoted lever and the movable mounting means comprises means for slidably mounting the pivoted lever for movement toward and away from the cutter member.

4. Apparatus as in claim 3, wherein the movable mounting means comprises a frame and means for mounting the frame on the housing for slidable movement and wherein the pivoted lever is mounted on the frame.

5. Apparatus as in claim 4, wherein the locking means comprise two spaced locking members on the housing and the frame includes means for engaging the locking members.

6. Apparatus as in claim 3, wherein the guide means comprises:

a guide member;

means for detachably mounting the guide member on the tape support member; and guide surfaces on the guide member for providing lateral guidance of tape placed on the tape support member.

7. Apparatus as in claim 6, wherein the means for mounting the cutter member comprises a cutter member receiving means for holding the cutter member and means for mounting the receiving means on the guide member for movement relative to the guide member.

8. Apparatus as in claim 7, wherein the guide member and the cutter member receiving means comprise an integral unit.

9. A printing apparatus comprising:

a housing;

guide means carried by the housing for guiding a tape-like printing medium;

printing means carried by the housing for printing data on the printing medium;

a cutting blade;

cutting blade mounting means for mounting the cutting blade for movement toward the printing medium, to cut the printing medium;

means for replaceably mounting the cutting blade mounting means on the housing;

a lever for moving the cutting blade toward the printing medium; and means for mounting the lever on the housing for movement between a first position, wherein the lever is positioned to move the cutting blade, and a second position, wherein the lever is spaced from the cutting blade to enable detachment of the cutting blade mounting means, from the housing.

10. Apparatus as in claim 9, further comprising a plurality of cutting blades, each blade being adapted to cut printing mediums of a width different from the other blades, each of the cutting blades including means for replaceably mounting the cutting blade, on the housing.

11. Apparatus as in claim 10, wherein each of the means for replaceably mounting the cutting blades further comprises printing medium guiding means for guiding printing medium of a width corresponding to an associated cutting blade.

12. Apparatus as in claim 10, further comprising a frame;

means mounting the frame on the housing for movement relative to the cutting blade; and means mounting the lever on the frame

13. Apparatus as in claim 12, further comprising locking means for locking the lever in the first position and the second position.

14. Apparatus as in claim 13, wherein the locking means comprises a pair of spaced locking elements on the housing and the frame further comprises means for engaging the locking elements.

15. Apparatus as in claim 14, wherein the spaced locking elements comprise raised portions of the housing and the means for engaging the locking elements comprises a yieldable member positioned to engage the raised portions.

16. A printing apparatus comprising:

a housing;

means carried by the housing for providing a cut length of a tape printing medium with data printed thereon from a continuous supply of said tape printing medium;

a tape guiding surface on the housing for receiving a cut length of the tape printing medium;

tape locating means disposed adjacent the tape guiding surface for maintaining the cut length of the tape printing medium adjacent the guiding surface;

mounting means associated with the locating means for readily detachably mounting the locating means with respect to the tape guiding surface;

lateral guide means for positioning the cut length of tape printing medium laterally on the tape guiding surface;

longitudinal stop means for positioning the cut length of tape printing medium longitudinally on the tape guiding surface;

a trimming member;

trimming member mounting means for mounting the trimming member on said locating means and astride the tape guiding surface; and a member carried by the housing for engaging the trimming member and urging the trimming member toward the tape guiding surface, whereby the trimming member is positioned to trim a cut length of tape printing medium disposed on the tape guiding surface.

17. Apparatus as in claim 16, wherein the means for mounting the locating means includes means for mounting the locating means on the tape guiding surface.

18. Apparatus as in claim 17, wherein the trimming member comprises:

a carrier;

a cutting blade in the carrier; and wherein the trimming member mounting means comprises means for mounting the carrier on the tape locating means for movement toward and away from the guide surface.

19. Apparatus as in claim 18, wherein the means for mounting the carrier on the tape locating means comprises a resiliently deformable portion extending between the tape locating means and the carrier.

* * * * *